US008967041B2

(12) United States Patent
Hecktor et al.

(10) Patent No.: US 8,967,041 B2
(45) Date of Patent: Mar. 3, 2015

(54) CONTAINER ALIGNMENT

(75) Inventors: Jan Peter Hecktor, Weitersburg (DE); Marius Michael Herrmann, Rosenheim (DE)

(73) Assignee: KHS GmbH, Dortmund (DE)

( * ) Notice: Subject to any disclaimer, the term of this patent is extended or adjusted under 35 U.S.C. 154(b) by 358 days.

(21) Appl. No.: 13/001,177

(22) PCT Filed: Jul. 29, 2009

(86) PCT No.: PCT/EP2009/005478

§ 371 (c)(1),
(2), (4) Date: Dec. 23, 2010

(87) PCT Pub. No.: WO2010/022838

PCT Pub. Date: Mar. 4, 2010

(65) Prior Publication Data

US 2011/0206496 A1 Aug. 25, 2011

(30) Foreign Application Priority Data

Aug. 29, 2008 (DE) ..... 10 2008 044 926

(51) Int. Cl.
*B65C 9/06* (2006.01)
*B65B 21/12* (2006.01)

(52) U.S. Cl.
CPC ..... *B65C 9/067* (2013.01)
USPC ..... 101/35; 356/240.1; 382/142

(58) Field of Classification Search
USPC ..... 356/240.1, 239.4, 239.7; 382/142; 198/384, 394; 101/35, 41
IPC ..... B65C 9/06; B65B 21/00,21/12
See application file for complete search history.

(56) References Cited

U.S. PATENT DOCUMENTS

| | | | | |
|---|---|---|---|---|
| 2,141,722 | A * | 12/1938 | Morgan | 40/311 |
| 5,415,268 | A * | 5/1995 | Lofgren | 198/394 |
| 2005/0035081 | A1 * | 2/2005 | Fitch | 215/246 |
| 2005/0045263 | A1 * | 3/2005 | Heuft et al. | 156/64 |
| 2009/0133593 | A1 * | 5/2009 | Till | 101/35 |
| 2011/0162332 | A1 * | 7/2011 | Hecktor et al. | 53/488 |
| 2012/0314213 | A1 * | 12/2012 | Herrmann et al. | 356/240.1 |

FOREIGN PATENT DOCUMENTS

| | | | |
|---|---|---|---|
| DE | 963 223 | | 5/1957 |
| DE | 1200197 | | 9/1965 |
| DE | 201 15 480 | | 5/2002 |
| DE | 10 2006 019441 | | 10/2007 |
| EP | 0 572 758 | | 12/1993 |
| EP | 608673 | A1 * | 8/1994 |
| WO | 03/024808 | | 3/2003 |

* cited by examiner

*Primary Examiner* — Leslie J Evanisko
(74) *Attorney, Agent, or Firm* — Occhiuti & Rohlicek LLP

(57) ABSTRACT

The invention relates to a device for aligning containers (1) comprising at least one detection system (7). In order to be able to apply identically orientated and aligned labels even to containers without embossings, the invention proposes that at least one detection system (7) is configured as a cover detection system (7) and is disposed so that a closure element (4) disposed on the container (1) can be detected.

12 Claims, 2 Drawing Sheets

CONTAINER ALIGNMENT

CROSS-REFERENCE TO RELATED APPLICATIONS

This application is the National Stage of International Application No. PCT/EP2009/005478, filed on Jul. 29, 2009, which claims the benefit of German Application Serial No. 10 2008 044 926.1 filed on Aug. 29, 2008. The contents of both of the foregoing applications are hereby incorporated by reference in their entirety.

FIELD OF INVENTION

The invention relates to a device for aligning containers, the device including at least one detecting system.

BACKGROUND

DE 963 223 is concerned with machines for closing bottles and other vessels with crown caps. These machines have cap mills that supply the crown caps from a cap container. The cap mills allow the caps, when in the correct position, to fall into a channel that leads to the closing head.

In order to obtain an alignment of the crown caps such that the inside is always placed onto the mouth opening of the container, DE 963 223 proposes providing two discs located on a plane, one above the other, at the outlet of the cap mill and circulating in the same direction, with magnets being located in said discs. The crown cap abutting against the bottom disc by way of the cover is conveyed into a channel and directly supplied to the closing head. The crown cap abutting by way of its flange is detected by the magnets of the top disc, is guided via the rotation of the discs, and in this manner conveyed into a channel and supplied to the closing head. Consequently a forced alignment of the crown caps is obtained by using a magnetic sorting means, the crown cap being oriented in each case with its cover up and its flange down.

Containers of the afore-mentioned type can be used, for example, as bottles for liquids, for example for beverages. The containers, e.g. bottles, can be produced from a transparent or translucent material, for example glass or a translucent plastic material, e.g. PET. However, it is also conceivable for the containers to be produced from other materials and to be fillable with other liquid products.

The filled containers are supplied, for example, to a labelling machine. Before labelling, the containers are rotated into a particular position at an alignment station such that the labels are always located in an identical position on the respective container. To rotate a container into the correct position, the alignment station includes a detecting system that was one or more detecting subsystems. The detecting system detects development features, for example, embossings on the container, in relation to which the labels or other characteristics are to be aligned and precisely positioned. By using the detecting system, development features throught the entire circumference of the container can be detected.

The containers, which are mounted on rotating turntables are moved past the detecting system. Once the containers have passed the detecting system, a signal generated by the detecting system causes the turntables to rotate into the desired position. Once the container has been correctly aligned, it is then labeled. As a result of the cooperation of the detecting system, the labels are always aligned identically and as desired in relation to the development features.

However, before the labelling operation the container is closed by the closure element.

In many cases, the closure element to exhibit a decoration or detecting symbol, for example a symbol of the beverage manufacturer. In practice, the closure elements, with their decoration or detecting symbol located on the cover are applied randomly with reference to the development features of the container. This means that once the bottles are labelled, the decorations on the closure elements will also be randomly oriented relative to the labels. Thus, even though the labels have been carefully aligned on the container to produce an aesthetically pleasing package, the closure element, because of its random orientation, very often ruins the entire carefully orchestrated presentation.

There are also containers that have no development features. As a result, there is no good way to align the labels on the containers. When viewed together with the closure elements, which are not aligned with reference to the labels or similar characteristics either, the resulting presentation is most unattractive to the consumer.

SUMMARY

The object of the invention is to improve a device of the aforementioned type with simple means such that labels or other symbols can be located on the container always oriented in an identical manner in relation to closure elements with their cover-side decorations or other features.

In an advantageous manner, it is provided that simply one single detecting system is located, for example, in an inlet to the labelling machine, as an example, such that said detecting system looks from above head-on onto the closure element or its cover-side decoration, and records a random position of the same as a top view.

The recorded data, or the recorded image is directed to an image-processing and control unit, which sends a corresponding signal to turntables on which the respective container is standing upright.

Once the container then reaches the labelling unit, as an example, the container is rotated in advance via the turntables such that the label to be applied onto the random position of the closure element can be applied in a targeted manner aligned onto the container.

In an advantageous manner, it is achieved with the invention that the container is alignable in a targeted manner in spite of not having any development features, by the containers being aligned in relation to the random position of the closure element or to its cover-side decoration.

By means of the invention according to the invention, it is achieved that the closure element is aligned in a targeted manner by way of its cover-side decoration in relation to labels to be applied or other container characteristics without the closure element being aligned. Rathermore, simply a random position of the closure element is recorded and stored such that it is only necessary for the containers to be rotated into the correct position in each case for labelling or similar.

All in all, the matched aligning of the closure element in relation to the label (or vice versa) also brings about a better appearance of the container and an improved perception by the user.

The closure element can be realized as a bounceable closure such as, for example, a crown cap. However, also conceivable is a closure element that is developed as a so-called maxi crown or ring-pull. For example, in the case of a ring-pull closure, there is an easily detectable advantage that the ring is aligned in a targeted manner in relation to the labels. In this respect, the closure elements according to the invention do not definitely have to have a cover-side decoration. Rathermore, the invention is also to include aligning containers according to the development features and/or operating features of the closure element.

The operating features can be realized, as mentioned, for example, as a ring (ring-pull, maxi-crown) such that the container is rotated after the ring. In a preferred design, the closure element is recorded from above such that it would be completely sufficient to record just one single element of the ring-pull or maxi-crown closure that is detectable in the top view. For example, the actual ring is located on a tear-off lug, which in terms of the invention also represents an operating element, and is detectable in top view by means of the detecting system. The container can be aligned or rotated advantageously after said operating element.

A lug located on the closure element could be recorded as another operating feature. These types of closure elements are known, for example, as algue caps. They can be opened by the user engaging the lug or the lug being acted upon by a downwardly acting pressure force such that the closure element is removable from the cap. The lug stands at an angle, preferably horizontally to the actual closure element, and is detectable in top view by the detecting system. Consequently the container can be rotated after the lug.

However, it is also conceivable to design the closure element as a clip-lock. In a more favourable manner, in this case, at least one element that is detectable in top view, for example an eye of the clip-lock, can be recorded by the detecting system such that the container can be rotated after at least said one element.

It is also conceivable for the closure element to be designed as a screw-type closure, for example as a twist off closure.

Naturally the containers can also have development features (embossings). In an advantageous manner the invention can also be applied in the case where the closure element is already aligned in relation to possible development features of the container. A further advantage of the invention can be seen when an alignment station with several detecting stations for detecting embossings or the like in the inlet of the labelling machine could be omitted. In this case, one single detecting system, preferably the cover detecting system according to the invention, would suffice, simply recording the position of the closure element, as said closure element is already aligned in relation to development features (embossings) of the container. The detecting system or the cover detecting system would look from above onto the closure element, and bring about a corresponding alignment of the container standing upright in the turntable. Consequently, the labelling machine can be produced in a more cost-efficient manner as a plurality of detecting systems for detecting development features (embossings) of the container can be dispensed with. Rathermore one single detecting system checking from above would suffice in order to align the containers such that the labels can be applied precisely aligned in relation to the development features of the container (and in relation to the closure element). Naturally, this is only of significance for closure elements that exhibit corresponding development features and/or operating features.

BRIEF DESCRIPTION OF THE FIGURES

Further advantageous developments of the invention are in the following detailed description and the accompanying figures, in which.

Identical parts in the different Figures are always provided with the same references, which is why, as a rule, they are only described once.

DETAILED DESCRIPTION

Figure 1:
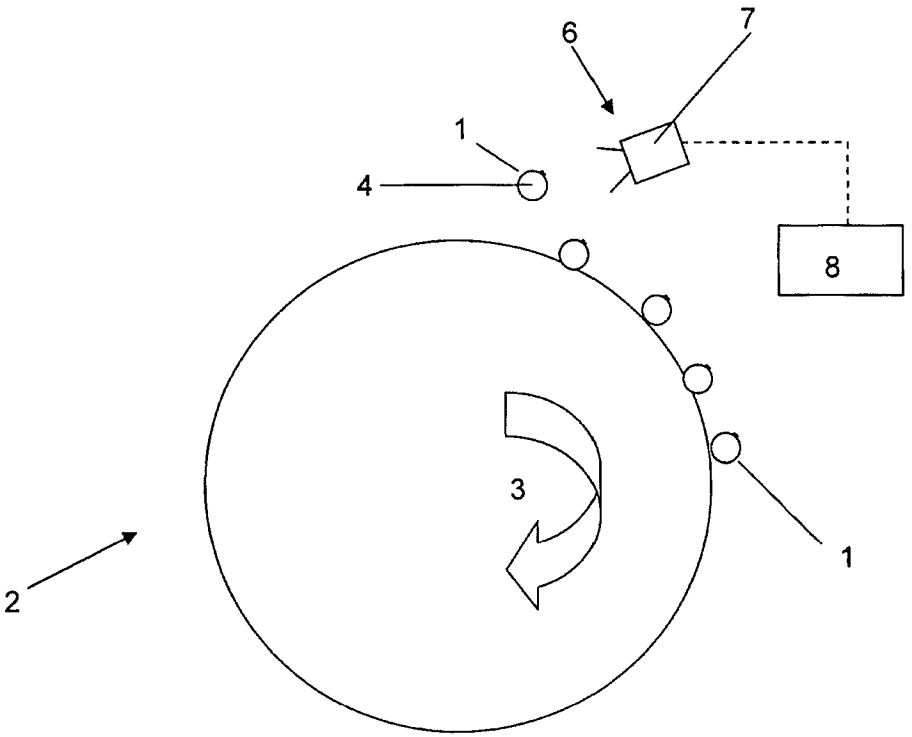
FIG. 1 shows a cover detecting system according to the invention in the inlet, for example, of a labelling machine.

In the example shown in FIG. 1, a container 1 moves into a labelling machine 2. The container 1 can be supplied to the labelling machine 2 via a conveyor belt or via a transfer star. Other kinds of machines can be used instead of labelling machines, and other mechanisms for moving the container can also be used.

Figure 2:
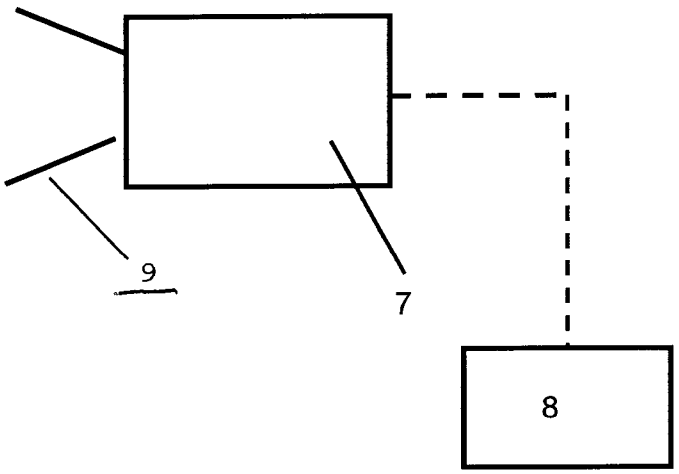
FIG. 2 shows a basic representation for recording a closure element or its cover-side decoration.
Figure 2:
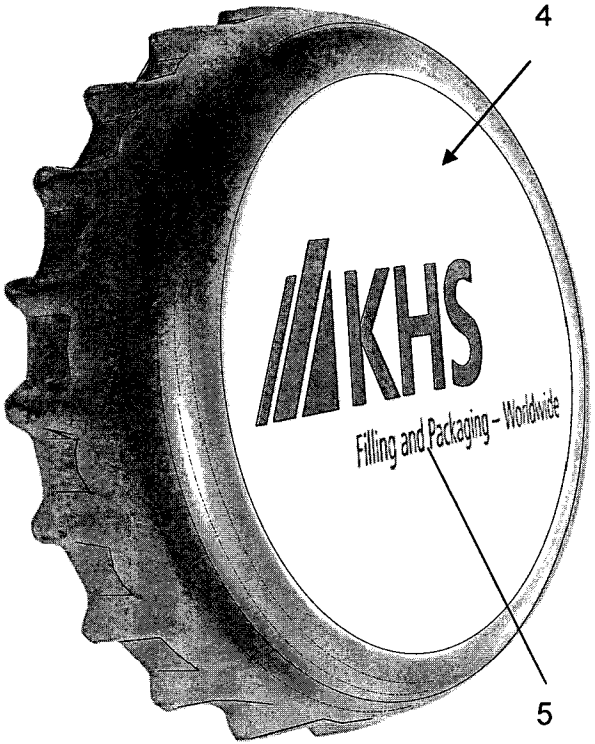

The labelling machine 2 is represented as a circle around the outer circumference of which the containers 1 are guided while being mounted on turntables. The labelling machine 2 rotates in a direction shown by the arrow arrow 3. The labelling units themselves are omitted for clarity. The in-coming containers 1 are closed with a closure element 4, an example of which is shown in FIG. 2.

A typical closure element 4 is a crown cap having a cover-side decoration 5. The particular decoration shown in the figure is by way of example only. All conceivable symbols or development features can be located on the closure element 4.

A device 6 for aligning the container 1 is located at the inlet to the labelling machine 2. The device includes at least one cover detecting system 7.

The cover detecting system 7 is located in an advantageous manner such that the cover-side decoration 5 of the closure element 4 is recordable by the cover detecting system 7, represented in principle as a camera. A head-on photo of the cover-side decoration 5 in its random position on the container 1 is taken vertically from above, as a top view.

In one embodiment, the cover-side decoration 5 is recorded in the random position of the closure element 4 before a packing tulip is fitted onto the container 1. Naturally a view of the cover-side decoration 5 of the closure element 4 can also be recorded through a transparent packing tulip 9 or for example through a hollow packing tulip.

The recorded image, or the recorded data at the random position of the closure element 4 located on the container 1, is sent to an image processing and control unit 8, which is in communication with the respective turntables.

The cover detecting system 7 is a component part of the control unit 8, in which the images or image data supplied by the cover detecting system 7 or the camera are evaluated. The processing of the images or image data supplied by the cover detecting system 7 is effected, for example, by a comparison with required data stored in the control unit 8. In this respect, the control unit 8 can also be identified as an image processing and control unit 8. In one embodiment, the control unit 8 is a computer or a computer-supported unit with corresponding inputs for analog or digital data supplied by the cover detecting system 7. In addition, the control unit 8 has outlets that have been omitted for clarity. These outlets are connected, for example, to a control unit of a turntable to enable that turntable to rotate a container 1, which is standing upright on the turntable, into the desired position.

Based on the random position of the closure element 4, the image processing and control unit 8 generates a signal that causes the turntable to rotate the container 1 to align it such that a label can be placed on the correct position on the container 1. This ensures that the label is always identically oriented and aligned in relation to the closure element 4 or to its cover-side decoration 5.

Naturally the invention is not to be restricted to the example of the labelling machine 1. A printing machine, which can be thought of as a species of labelling machine, can also be used.

A similar problem will exist since one would like the printed image to be correctly aligned with any cover decorations.

Having described the invention, and a preferred embodiment thereof, what we claim as new and secured by Letters Patent is:

1. An apparatus for aligning containers, said apparatus comprising: a tulip, at least one detecting system, the at least one detecting system including a cover-detecting system located such that a closure element located on a container is recordable through the tulip, wherein the tulip is configured to be fitted on said container, wherein the tulip is disposed between the cover-detecting system and the closure element, and wherein the tulip provides a view of the closure element from the cover-detecting system.

2. The apparatus of claim 1, wherein the cover-detecting system is located such that a random position of the closure element located on the container is recordable as a top view.

3. The apparatus of claim 1, wherein the tulip is a transparent tulip.

4. The apparatus of claim 1, wherein the tulip is a hollow tulip.

5. A method for the targeted aligning of a container using an apparatus having a cover-detecting system located such that a closure element located on the container is recordable through a tulip, said method comprising: using the cover-detecting system to record a closure element located on the container through the tulip, thereby generating recorded data, using an image-processing-and-control unit to process the recorded data, the image-processing-and-control unit being in communication with a turntable on which the container is standing upright, and using a signal generated in the control unit, causing the turntable to rotate the container.

6. The method of claim 5, further comprising recording a cover-side, wherein rotating the container occurs after the cover-side decoration is recorded.

7. The method of claim 5, further comprising recording an operating element of the closure element, wherein rotating the container occurs after the operating element is recorded.

8. The method of claim 7, wherein the operating element comprises a ring located on the closure element.

9. The method of claim 7, wherein the operating element comprises a lug located on the closure element.

10. The method of claim 5, wherein the closure element comprises a clip-lock, the method further comprising recording at least one element of the clip-lock, wherein the container is rotated after at least one element of the clip-lock is recorded.

11. The method of claim 5, further comprising selecting the tulip to be a hollow tulip.

12. The method of claim 5, further comprising selecting the tulip to be a transparent tulip.

* * * * *